US009544968B2

(12) United States Patent
Matsubayashi et al.

(10) Patent No.: US 9,544,968 B2
(45) Date of Patent: Jan. 10, 2017

(54) ILLUMINATION APPARATUS

(71) Applicant: PANASONIC INTELLECTUAL PROPERTY MANAGEMENT CO., LTD., Osaka (JP)

(72) Inventors: Yoko Matsubayashi, Osaka (JP); Tohru Himeno, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/062,432

(22) Filed: Mar. 7, 2016

(65) Prior Publication Data

US 2016/0270180 A1 Sep. 15, 2016

(30) Foreign Application Priority Data

Mar. 11, 2015 (JP) ..... 2015-048596

(51) Int. Cl.
*H05B 33/08* (2006.01)
*F21K 99/00* (2016.01)
*F21Y 113/00* (2016.01)

(52) U.S. Cl.
CPC ..... *H05B 33/0857* (2013.01); *F21K 9/50* (2013.01); *F21Y 2113/002* (2013.01); *F21Y 2113/005* (2013.01); *F21Y 2113/007* (2013.01)

(58) Field of Classification Search
CPC ..... F21Y 2113/002; F21Y 2113/005; F21Y 2113/007; F21K 9/50; H05B 33/0857
See application file for complete search history.

(56) References Cited

U.S. PATENT DOCUMENTS

2011/0037080 A1* 2/2011 Emerson ..... H01L 25/0753 257/88
2011/0260633 A1 10/2011 Takeda et al.
2015/0029713 A1* 1/2015 Fieberg ..... H05B 33/0857 362/231
2015/0123946 A1 5/2015 Kawamura et al.
2015/0124431 A1 5/2015 Motoya et al.
2016/0074620 A1 3/2016 Toda et al.
(Continued)

FOREIGN PATENT DOCUMENTS

JP 2008-218485 9/2008
JP 2009-260390 11/2009
(Continued)

*Primary Examiner* — Douglas W Owens
*Assistant Examiner* — Pedro C Fernandez
(74) *Attorney, Agent, or Firm* — Greenblum & Bernstein, P.L.C.

(57) ABSTRACT

An illumination apparatus includes a first LED, a second LED, and a control unit. The first LED emits white light. The second LED emits white light having a correlated color temperature lower than that of the white light emitted from the first LED and a chromaticity deviation Duv higher than that of the white light emitted from the first LED. The control unit changes a light output ratio of the first LED and the second LED. The first LED emits the white light of the correlated color temperature ranging from 1563K to 4500K and the chromaticity deviation Duv ranging from −1.6 to −12. The second LED emits the white light of the correlated color temperature ranging from 1563K to 4500K and the chromaticity deviation Duv ranging from +10 to −1.6.

8 Claims, 17 Drawing Sheets

(56) References Cited

U.S. PATENT DOCUMENTS

2016/0195227 A1* 7/2016 Rooijmans ..... F21K 9/50
362/231

FOREIGN PATENT DOCUMENTS

| | | |
|---|---|---|
| JP | 2011-176300 | 9/2011 |
| JP | 2012-047019 | 3/2012 |
| JP | 2014-075186 | 4/2014 |
| JP | 2014-086271 | 5/2014 |

* cited by examiner

FIG.5A

| 3000K | −15 | −12 | −9 | −6 | −3 | 0 | 3 | 6 |
|---|---|---|---|---|---|---|---|---|
| LEGIBILITY | | | ○ | | | | | |
| WHITENESS | | | | ○ | | | | |
| PREFERENCE | | | | ○ | | | | |

FIG.5B

| 3500K | −15 | −12 | −9 | −6 | −3 | 0 | 3 | 6 |
|---|---|---|---|---|---|---|---|---|
| LEGIBILITY | | | | ○ | | | | |
| WHITENESS | | | | ○ | | | | |
| PREFERENCE | | | | ○ | | | | |

FIG.5C

| 4000K | −15 | −12 | −9 | −6 | −3 | 0 | 3 | 6 |
|---|---|---|---|---|---|---|---|---|
| LEGIBILITY | | | | | ○ | | | |
| WHITENESS | | | | | ○ | | | |
| PREFERENCE | | | | | ○ | | | |

*FIG.5D*

| 5000K | −15 | −12 | −9 | −6 | −3 | 0 | 3 | 6 |
|---|---|---|---|---|---|---|---|---|
| LEGIBILITY | | | | ○ | | | | |
| WHITENESS | | | | ○ | | | | |
| PREFERENCE | | | | | ○ | | | |

*FIG.5E*

| 6200K | −15 | −12 | −9 | −6 | −3 | 0 | 3 | 6 |
|---|---|---|---|---|---|---|---|---|
| LEGIBILITY | | | | ○ | | | | |
| WHITENESS | | | | | ○ | | | |
| PREFERENCE | | | | | ○ | | | |

ILLUMINATION APPARATUS

CROSS-REFERENCE TO RELATED APPLICATIONS

This application claims priority to Japanese Patent Application No. 2015-048596 filled on Mar. 11, 2015, the entire contents of which are incorporated herein by reference.

TECHNICAL FIELD

The disclosure relates to an illumination apparatus having an LED as a light source; and more particularly, to an illumination apparatus for applying light for relaxing a user and light for making characters legible in a low color temperature environment where a correlated color temperature is 4500K or less.

BACKGROUND ART

Conventionally, an illumination apparatus has been developed to realize an original color of an illumination target. Specifically, it is preferable to make visual performance of various colors of the illumination target closer to visual performance thereof under a reference light. This can be objectively evaluated by using a general color rendering index.

However, the general color rendering index Ra is not enough for an index for evaluating "legibility" of characters written on a paper. Therefore, a chroma value that is calculated by using the simple version of the CIE 1997 Interim Color Appearance Model is known as an index for quantitatively calculating whiteness of a paper from correlation between the whiteness of the paper and the "legibility" of characters.

As for an illumination apparatus for irradiating light of a controlled chroma value, there is known one for irradiating light of a correlated color temperature ranging from 5400K to 7000K (see, e.g., Japanese Patent Application Publication No. 2014-75186).

In the case of using such an illumination apparatus described above as a task illumination apparatus in a low color temperature environment, a large difference in correlated color temperature exists between task illumination light and ambient illumination light and this makes a user uncomfortable. Although the light irradiated from such an illumination apparatus improves legibility of characters, it does not make a user, who is reading a book before sleep, feel relax for a comfortable sleep.

SUMMARY OF THE INVENTION

In view of the above, the disclosure provides an illumination apparatus capable of irradiating light for relaxing a user and light for making characters legible without discomfort in a low color temperature environment.

In accordance with an aspect of the disclosure, there is provided an illumination apparatus which includes a first LED, a second LED, and a control unit. The first LED is configured to emit white light. The second LED is configured to emit white light having a correlated color temperature lower than a correlated color temperature of the white light emitted from the first LED and a chromaticity deviation higher than a chromaticity deviation of the white light emitted from the first LED. The control unit is configured to change a light output ratio of the first LED and the second LED. The first LED emits the white light of the correlated color temperature ranging from 1563K to 4500K and the chromaticity deviation ranging from −1.6 to −12. The second LED emits the white light of the correlated color temperature ranging from 1563K to 4500K and the chromaticity deviation ranging from +10 to −1.6.

In this disclosure, an illumination light has a low correlated color temperature, the first LED emits white light which makes a paper look white and the second LED emits white light having a low degree of awakening. Therefore, in the case of using the illumination apparatus of the disclosure in a low color temperature environment, it is possible to irradiate light for relaxing a user and light for making characters legible without discomfort.

BRIEF DESCRIPTION OF THE DRAWINGS

The figures depict one or more implementations in accordance with the present teaching, by way of example only, no by way of limitations. In the figures, like reference numerals refer to the same or similar elements.

FIGS. 5A to 5E show the summary of the evaluation values of FIG. 4.

DETAILED DESCRIPTION

Figure 1:
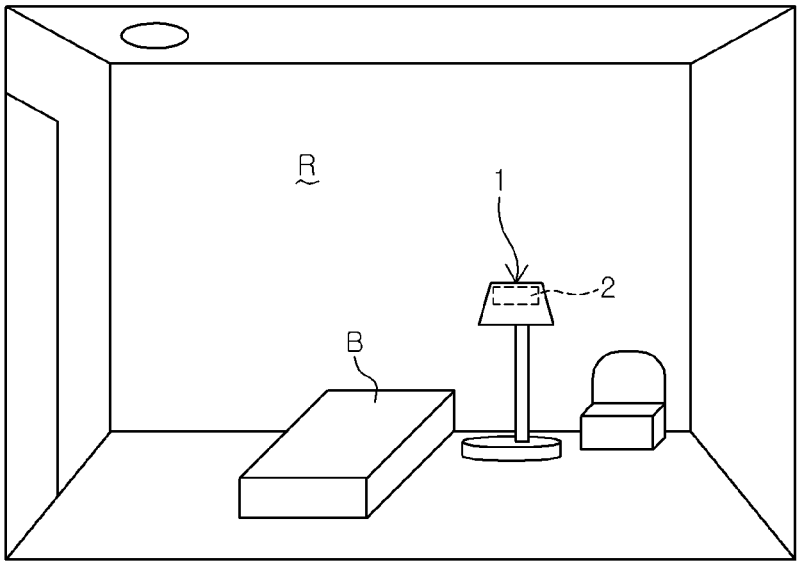
FIG. 1 is a perspective view showing a bedroom where an illumination apparatus according to an embodiment is installed.

An illumination apparatus according to an embodiment will be described with reference to the accompanying drawings. As shown in FIG. 1, an illumination apparatus 1 is configured as, e.g., a bedside lamp provided near a bed B in a bedroom R. The illumination apparatus 1 includes a light source unit 2 for emitting light.

Figure 2A:
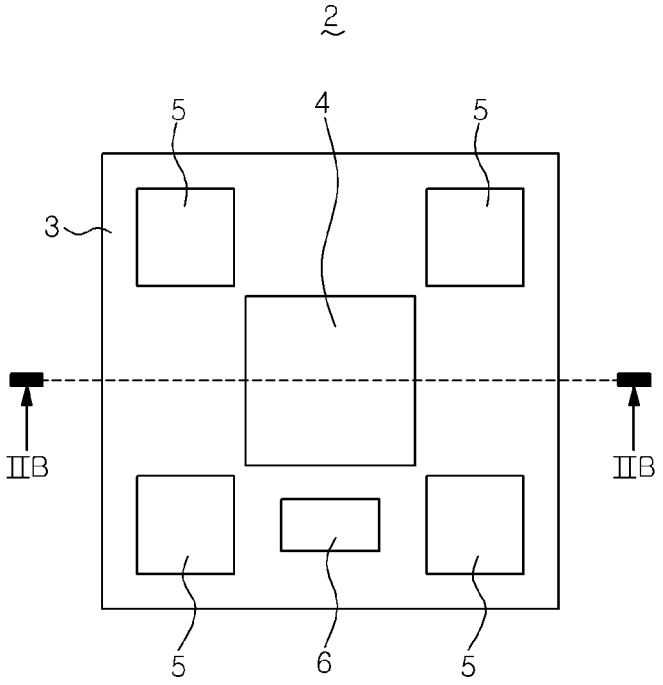
FIG. 2A is a top view of a light source unit of the illumination apparatus and FIG. 2B is a cross sectional view taken along line IIB-IIB of FIG. 2A.
Figure 2B:
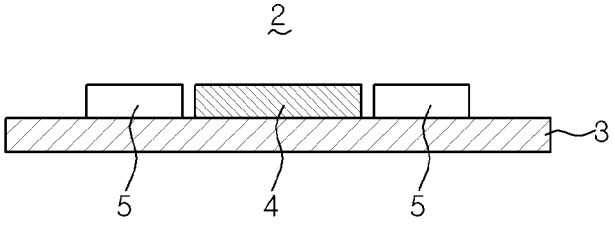

As shown in FIGS. 2A and 2B, the light source unit 2 has a wiring substrate 3, a first LED 4 and second LEDs 5 installed on one surface of the wiring substrate 3, and a control unit 6 for controlling a light output ratio of the first LED 4 and the second LEDs 5. In the illustrated example, the wiring substrate 3 has a rectangular flat plate shape. The first LED 4 is installed at a central portion of the wiring substrate 3 and the second LEDs 5 are installed at four corners of the wiring substrate 3. The first LED 4 and the second LEDs 5 are arranged such that optical axes thereof are perpendicular to the wiring substrate 3. Further, the first LED 4 and the second LEDs 5 are configured as white LEDs for emitting white light of a correlated color temperature ranging from 1563K to 4500K.

A test was performed to find out how to control a chromaticity deviation Duv in order to improve legibility of characters written on a paper when the first LED 4 irradiates light of a low correlated color temperature ranging from 1563K to 4500K. The chromaticity deviation Duv referred here is disclosed in Note of "5.4 Application range of correlated color temperature" of JIS Z8725-1999 "Methods for determining distribution temperature and color temperature or correlated color temperature of light sources". Further, the chromaticity deviation Duv is 1000 times greater than the chromaticity deviation disclosed in ISO or the like.

In this test, reference light and test light were irradiated under the conditions of an illuminance of 500 lx and correlated color temperatures of 3000K, 3500K, 4000K, 5000K or 6200K, and the legibility of characters was verified by test subjects under the respective conditions. The reference light had Duv of zero at the respective correlated color temperatures. The test light had Duv of 3, −3, −6, −9, −12 or −15 at the correlated color temperature of 4000K or less and Duv of 6, 3, −3, −6, −9 or −12 at the correlated color temperature of 5000K or above. The reference light and the test light were generated by controlling optical characteristics of light emitted from a xenon lamp by using a liquid crystal filter combined with the xenon lamp. The test subjects were made to read 30 characters that were recited from Japanese version of Minnesota Reading Acuity Chart (MNREAD-J) and printed at a size of 7 point at the center of an average plain copy paper. The test subjects were twelve males/females at the age of 24 to 51.

In the test, the test subjects were made to read the characters for 5 seconds under the reference light after they adapted to the reference light for 3 minutes, and then the test subjects were made to read the characters for 5 seconds under the test light after they adapted to the test light for 40 seconds. In this manner, the legibility of characters was evaluated. After performing the above initial evaluation, the test subjects were made to adapt to the reference light for 40 seconds and to read the characters for 10 seconds under the reference light, and then, the test subjects were made to adapt themselves to the test light for 40 seconds and to read the characters for 5 second under the test light. These processes after the initial were repeated. The evaluation was performed as subjective evaluation which includes color-naming method (absolute evaluation method) and magnitude estimation method (relative effect method). In the color-naming method, legibility was evaluated under the test light by distinguishing the appearance of a paper on which characters are written by "whiteness" and "tone". In the magnitude estimation method, the characters under the reference light and the characters under the test light were compared on a pair basis.

In the color naming method, first, the test subjects distinguished the appearance of a paper under the reference light and the test light by "whiteness" and "tone" such that the sum of proportions of "whiteness" and "tone" becomes 100. Thereafter, if the tone was felt, the color was selected between two things: "yellow to green" and "reddish purple to bluish purple". When the "yellow to green" was selected, the numerical value of the tone was set to positive, and when the "reddish purple to bluish purple" was selected, the numerical value of the tone was set to negative.

Figure 3:
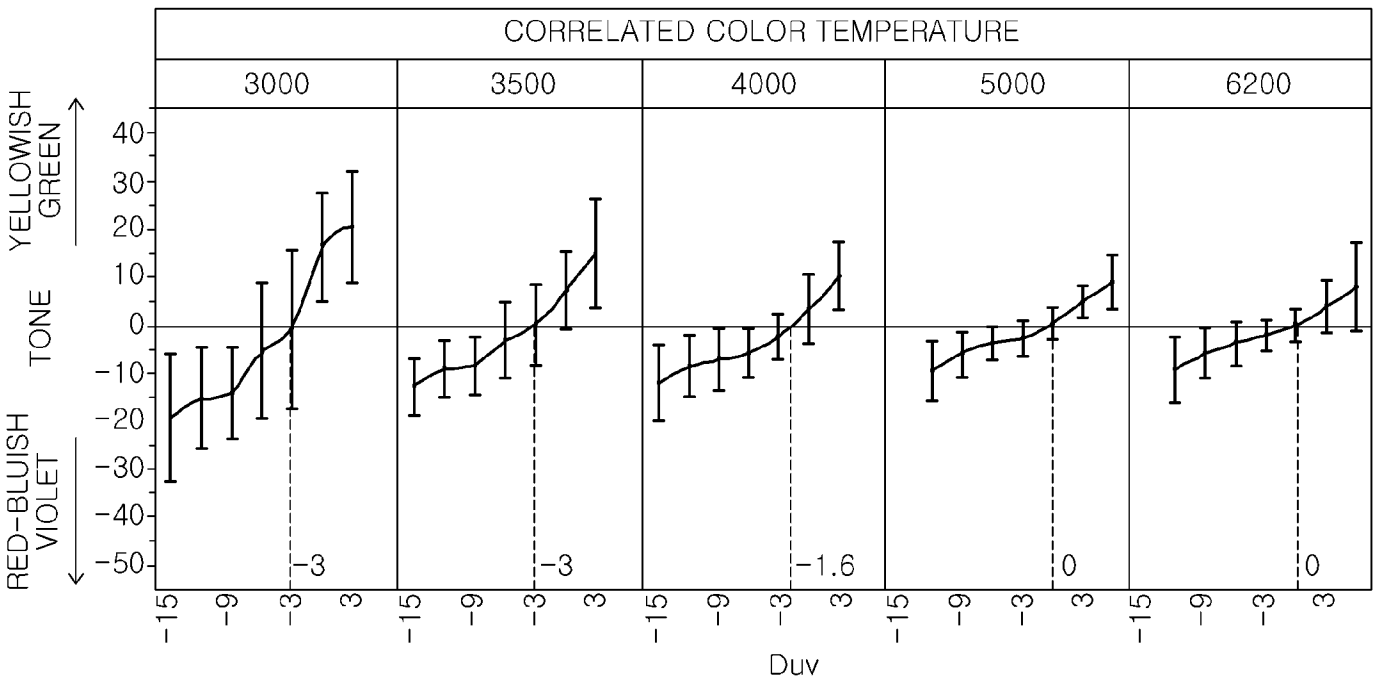
FIG. 3 shows relation between a color of a paper and a chromaticity deviation Duv under task illumination light of various correlated color temperatures.

As a result, as shown in FIG. 3, it has been found that when the correlated color temperatures of the reference light and the test light is 3000K, if Duv of the lights is set to −3, the tone becomes zero, so that the test subjects recognize the paper as white color. It has also been found that if Duv of the lights is set to greater than −3, the tone of yellowish to green increases, and on the contrary, if Duv of the lights is set to less than −3, the tone of red-bluish violet increases. Similar change tendency was observed on the other correlated color temperatures. However, as the correlated color temperature became lower, a change width of the tone more increased and effect of Duv on the white became stronger.

Further, it has been found that when the correlated color temperature of both the reference light and the test light is 3500K, 4000K, 5000K and 6200 K, if Duv is set to −3, 1.6, 0, 0, respectively, the tone becomes zero. As such, Duv at which the tone is zero varied depending on the correlated color temperature.

On the other hand, in the magnitude estimation method, a degree of legibility of characters under the reference light was set to 100. If the characters under the test light are more legible than under the reference light, the "legibility" was evaluated as a numerical value larger than 100, and if the characters under the test light are less legible than under the reference light, the "legibility" was evaluated as a numerical value smaller than 100. In a similar way, under the reference light and the test light, "whiteness" of a paper and "preference" of a paper appearance were evaluated.

Figure 4:
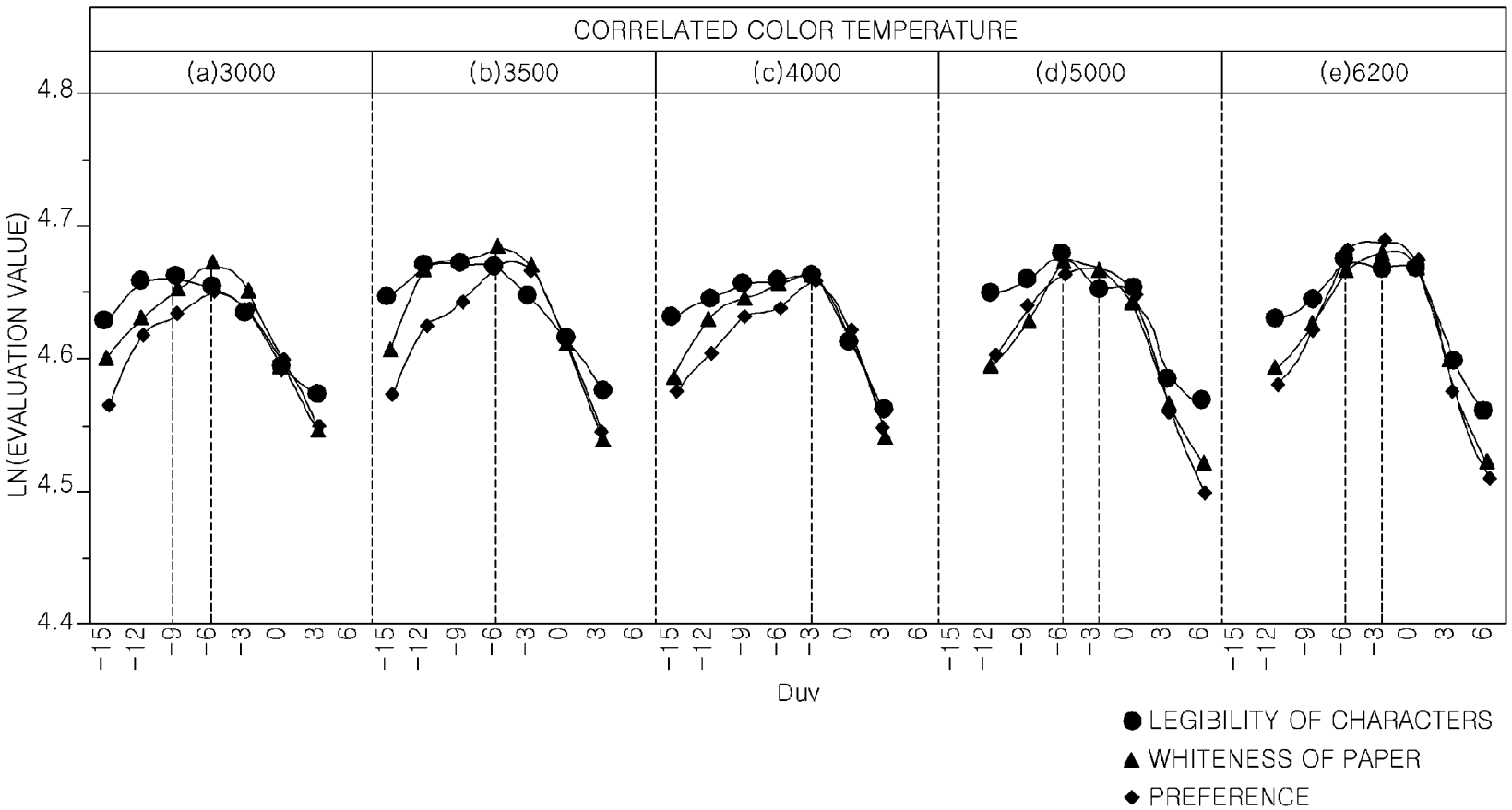
FIG. 4 shows relation among of evaluation values the chromaticity deviation Duv, legibility of characters, whiteness of a paper, and preference under the task illumination light of various correlated color temperatures.

As a result, as shown in FIG. 4, when the correlated color temperature of both the reference light and the test light was 3000 K, the "legibility of characters" was highest at Duv −9 and the "whiteness" of a paper and "preference" of a paper appearance was highest at Duv −6. In the same manner, with respect to the correlated color temperatures of 3500K, 4000K, 5000K and 6200K, optimal Duv values were obtained for "the "legibility of characters", the "whiteness" of a paper, and the "preference" of a paper appearance.

FIGS. 5A to 5E show the summary of the results in FIG. 4. As can be seen from FIG. 5A, at the correlated color temperature of 3000K, the "legibility", the "whiteness" and the "preference" were highest when Duv was set to −9, −6 and −6, respectively, as described above (indicated by circles). A t-test of a significant difference was performed for the highest evaluation value in each evaluation item. According to the t-test, there was no significant difference in all the evaluation items when Duv was within a range from −12 to −3 (ranges where there was no significant difference are indicated by dots).

As can be seen from FIG. 5B, at the correlated color temperature of 3500K, all the evaluation items were highest when Duv was set to −6. The "legibility" had no significant difference when Duv was within a range from −15 to −3. The "whiteness" and the "preference" had no significant difference when Duv was within a range from −12 to −3. As can be seen from FIG. 5C, at the correlated color temperature of 4000K, all the evaluation items were highest when Duv was set to −3. The "legibility" had no significant difference when Duv was within a range from −15 to −3. The "whiteness" had no significant difference when Duv was within a range from −12 to 0. The "preference" had no significant difference when Duv was within a range from −9 to −3. As can be seen from FIG. 5D, at the correlated color temperature of 5000K, the "legibility" and the "whiteness" were highest when Duv was set to −6 and the "preference" was highest when Duv was set to −3. The "legibility" had no significant difference when Duv was within a range from −12 to 0. The "whiteness" and the "preference" had no significant difference when Duv was within a range from −9 to 0. As can be seen from FIG. 5E, at correlated color temperature of 6200K, the "legibility" was highest when Duv was set to −6 and the "whiteness" and the "preference" were highest when Duv was set to −3. The "legibility" had no significant difference when Duv was within a range from −12 to 0. The "whiteness" and the "preference" had no significant difference when Duv was within a range from −6 to 0.

Figure 6:
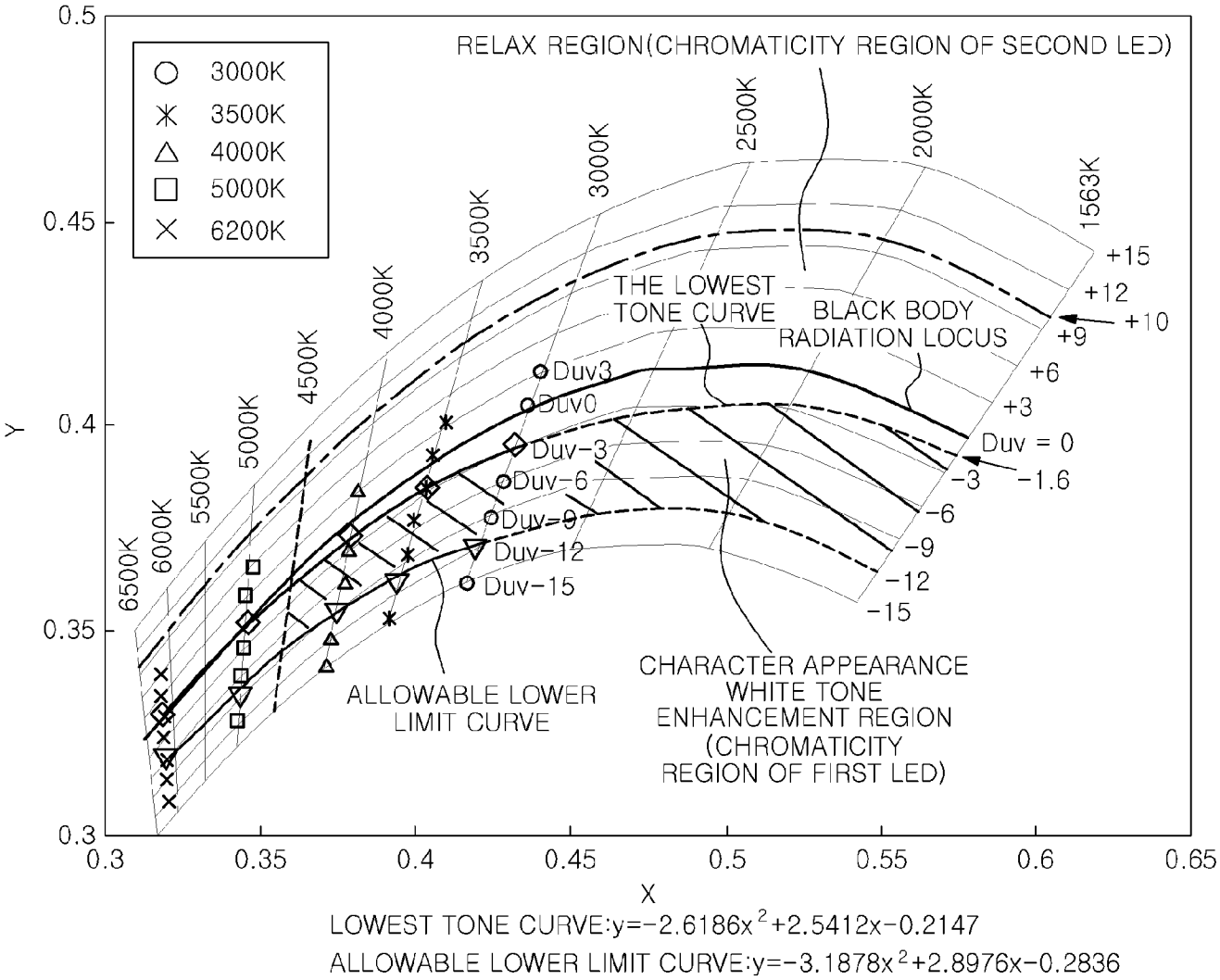
FIG. 6 is an xy chromaticity diagram showing distribution of a relax region and a whiteness improvement region where characters can be seen.

FIG. 6 is a graph in which results evaluated by the color-naming method and the magnitude estimation method described above are shown in an overlapping manner in an xy chromaticity diagram. For example, when the correlated color temperature of the reference light and the test light is 3000 K (indicated by a circle), marks corresponding to Duv 3, 0, −3, −6, −9, −12 and −15 are plotted from above in the chromaticity diagram in that order (indicated by circles). Among those, the mark of Duv −3 has a diamond shape indicating that the tone of a paper is zero in the color naming method (see FIG. 3). From the magnitude estimation method (see FIG. 5A), it was already known that there was no significant difference between the case of Duv being −3 and the cases of Duv being −6, −9, and −12 with respect to all the "legibility", "whiteness" and "preference". However, Duv −12, which is the lowest Duv in those having no significant difference, is plotted by a triangle mark. Similarly, for each of the other correlated color temperatures, a diamond mark and a triangle mark are plotted.

A line connecting the diamond marks at the respective correlated color temperatures is referred to as "lowest tone curve" indicating that it is difficult to recognize the tone of paper. The lowest tone curve is expressed as an approximate curve of the following equation 1. According to the approximate curve of the equation 1, at the correlated color temperature of 1563K, Duv was −1.6. A line connecting the inverted triangular marks at the respective correlated color temperatures is referred to as "allowable lower limit curve" indicating a lower limit that can obtain the same effect as the points on the lowest tone curve. The allowable lower limit curve is expressed as an approximate curve of the following equation 2. According to the approximate curve of the equation 2, at the correlated color temperature of 1563K, Duv was −12. A region (indicated by oblique lines) surrounded by the lowest tone curve, the allowable lower limit curve and the line indicating the correlated color temperature of 4500K is referred to as "characters appearance white tone enhancement region" in which the characters are legible and the white color of a paper is easily recognized in a low color temperature environment. By controlling Duv to plot within characters appearance white tone enhancement region, the first LED 4 can emit white light for allowing the characters written on the paper to be easily legible.

$$y=-2.6186x^2+2.5412x-0.2147 \quad \text{Eq. 1}$$

$$y=-3.1878x^2+2.8976x-0.2836 \quad \text{Eq. 2}$$

Figure 7:
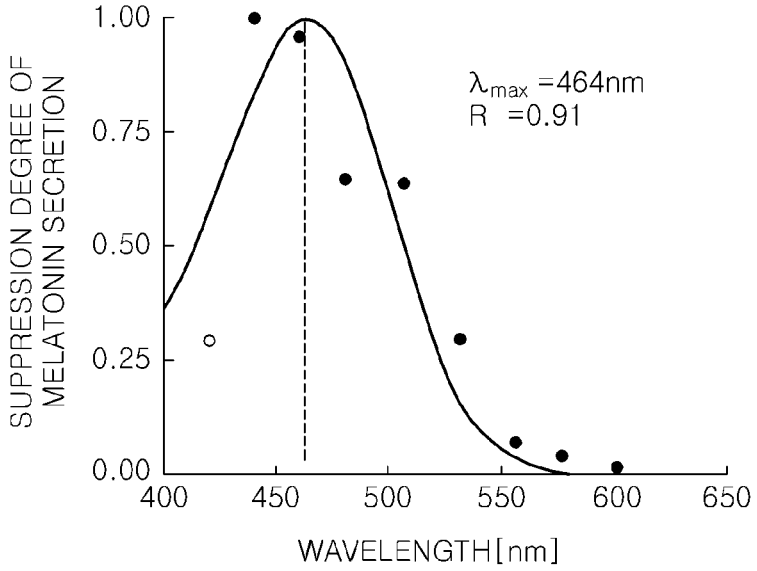
FIG. 7 shows relation between a wavelength of irradiation light and a degree of melatonin secretion suppression.

Next, under the conditions that the second LEDs 5 irradiate light of a low correlated color temperature of 1563K to 4500K, it was examined how to control Duv to obtain a low degree of awakening for relaxing a user. The degree of awakening is closely related to melatonin that is a hormone secreted by a pineal gland in the brain. The secretion of melatonin decreases a body temperature or facilitates falling asleep, so that the user can relax. As shown in FIG. 7, there is known that the secretion of melatonin is strongly suppressed by the light of a wavelength of 464 nm. Therefore, it is possible to decrease the degree of awakening and relax the user by cutting the light of a wavelength close to 464 nm.

Light of a wavelength close to 464 nm corresponds to blue light of a high correlated color temperature. By cutting the light of a wavelength close to 464 nm, the color temperature of the irradiation light is decreased and Duv is increased. In other words, in order to obtain light for relaxing a user, it is preferable to increase Duv and decrease the correlated color temperature of the irradiation light. Therefore, a Duv region above the lowest tone curve shown in FIG. 6 is referred to as "relax region" where a user can relax. In the illustrated example in FIG. 6, an upper limit Duv of the relax region was Duv +10 (indicated by a thick dashed dotted line). By controlling Duv to plot within the relax region between the lowest tone curve and the curve indicating Duv +10, the second LED 5 can emit white light that relaxes the user with a low degree of awakening.

Next, a test was executed to examine relationship among a correlated color temperature, an illuminance, and a change in pupil diameter of a test subject. A pupil diameter has the same function as that of an iris diaphragm of a camera. By narrowing a pupil, a focused range is increased (depth of field is increased). In this test, as a light source, there was used combination of a white LED for emitting white light having Duv of −3 at a correlated color temperature of 3000K and a blue LED for emitting blue light having a peak wavelength of 480 nm. The illuminance was set to five levels, i.e., 300 lx, 500 lx, 750 lx, 1000 lx and 1500 lx. The correlated color temperature was set to five levels, i.e., 3000K, 3500K, 4000K, 5000K and 6200K.

In the test, under illumination light having a predetermined illuminance and a predetermined correlated color temperature, two subjects in their twenties and forties were made to put their chins on chin rests and stare at a black spot having a diameter of 4 mm from a sight distance of 45 cm. In this state, the diameters of pupils of the subjects were measured three times. The pupil diameter was measured by using an eye mark recorder (EMR-9) of a cap type produced by NAC Image Technology, Inc. First, the illuminance was set to 300 lx, and the subjects were adapted to a light having the correlated color temperature of 3000 K for 3 minutes. Then, the pupil diameters of the subjects were measured for 15 seconds. Next, for each of lights having the correlated color temperatures of 3500 K, 4000 K, 5000 K and 6200 K, in this sequence, the subjects were adapted to the light for 1 minute and the pupil diameters were measured for 15 seconds. Thereafter, with respect to the illuminances of 500 lx, 750 lx, 1000 lx and 1500 lx, the pupil diameters were measured about each correlated color temperature in the same manner as the case of illuminance of 300 lx.

Figure 8A:
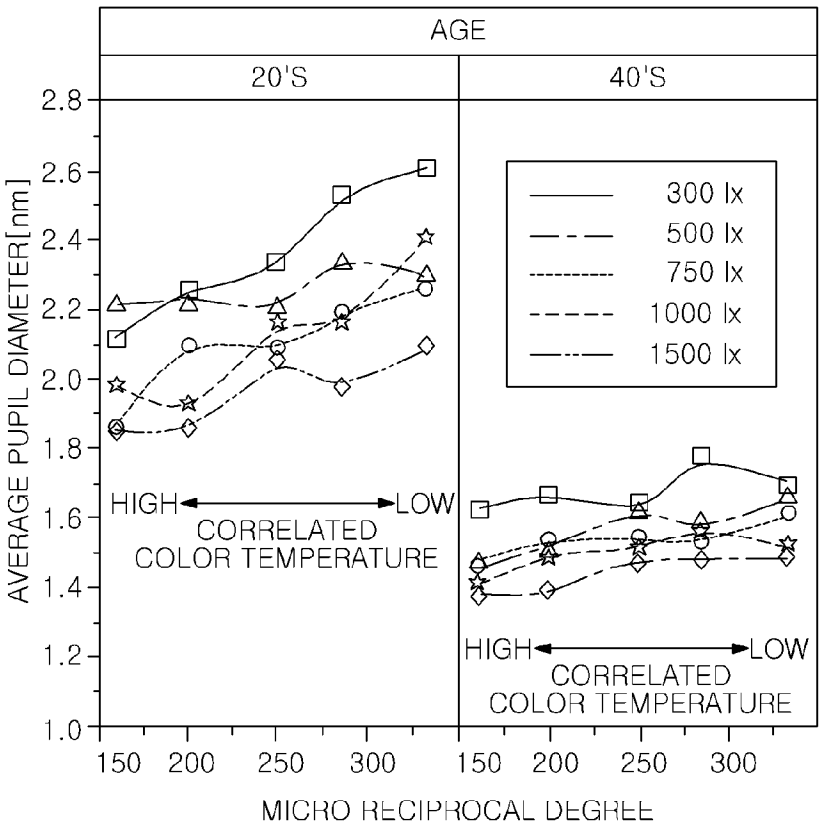
FIGS. 8A and 8B show average pupil diameters of test subjects under various correlated color temperatures and illuminances.
Figure 8B:
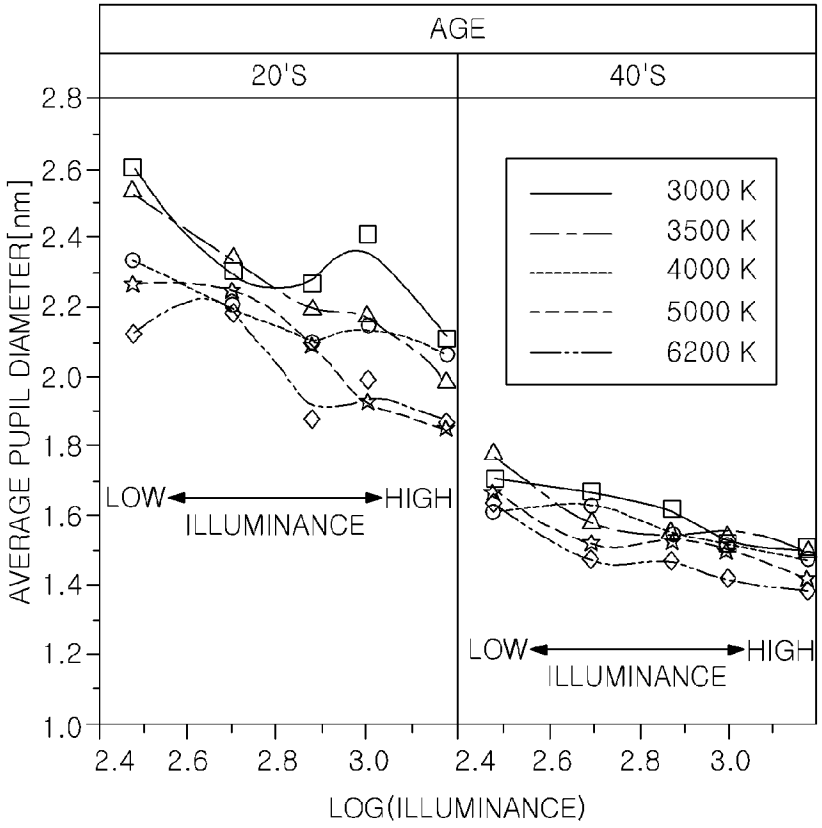

On the graph of FIG. 8A, an average pupil diameter is plotted about the mired ($10^6$ times the reciprocal of the correlated color temperature). On the graph of FIG. 8B, the average pupil diameter is plotted about the logarithmic value of the illuminance. The average pupil diameter was calculated as an average value in a section ranging from 5 to 10 seconds when the start time of the measurement is 0 second, after filtering by a moving median value of 10 points back and forth (total 21 points), except the measurement errors such as the blink. As a result, it has been found that the average pupil diameter decreases as the correlated color temperature increases and also as the illuminance increases.

Figure 9:
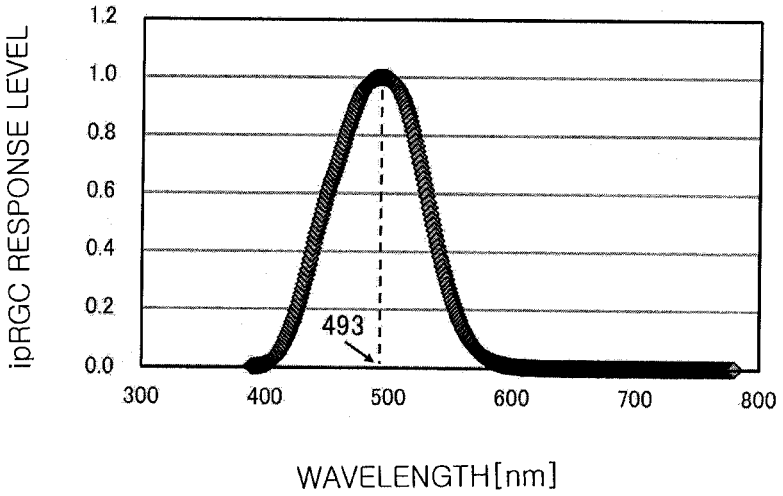
FIG. 9 shows a spectral sensitivity curve of intrinsically photosensitive retinal ganglion cell (ipRGC).

As the visual cells related to the adjustment of the pupil diameter, there are known intrinsic photosensitive retinal ganglion cells (ipRGCs). The ipRGCs are a third class of photoreceptors following the pyramidal cells and the rod cells. As shown in FIG. 9, it is known that the ipRGCs respond most efficiently to light having a wavelength of 493 nm.

Figure 10:
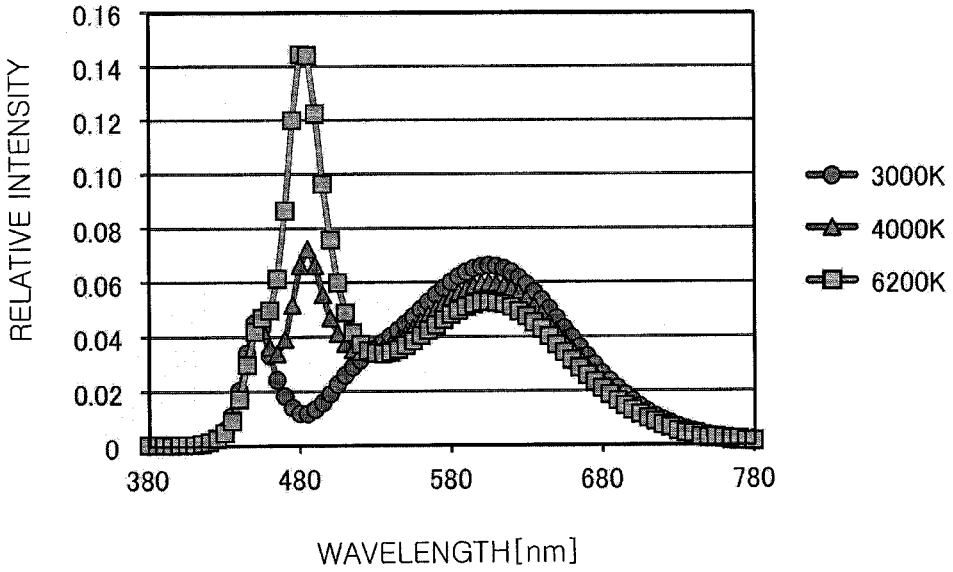
FIG. 10 shows spectral distribution of light of various correlated color temperatures.

FIG. 10 shows a spectrum distribution curve of light having the correlated color temperature of 3000 K, 4000 K and 6200 K used in this test. The light having the correlated color temperature of 6200 K includes considerable amount of light having wavelength of 493 nm and thus has high ipRGC stimulus level, whereas the light having the correlated color temperature of 3000 K includes little amount of light having wavelength of 493 nm and thus has low ipRGC stimulus level. An integrated value of the spectrum distribution curve and an ipRGC response level was calculated and a stimulus level of the ipRGC by the light of each correlated color temperature was obtained. The ipRGC stimulus level was standardized by setting an ipRGC stimulus level by light emitted from a standard light source D65 (at the illuminance of 1000 lx) to 100.

Figure 11:
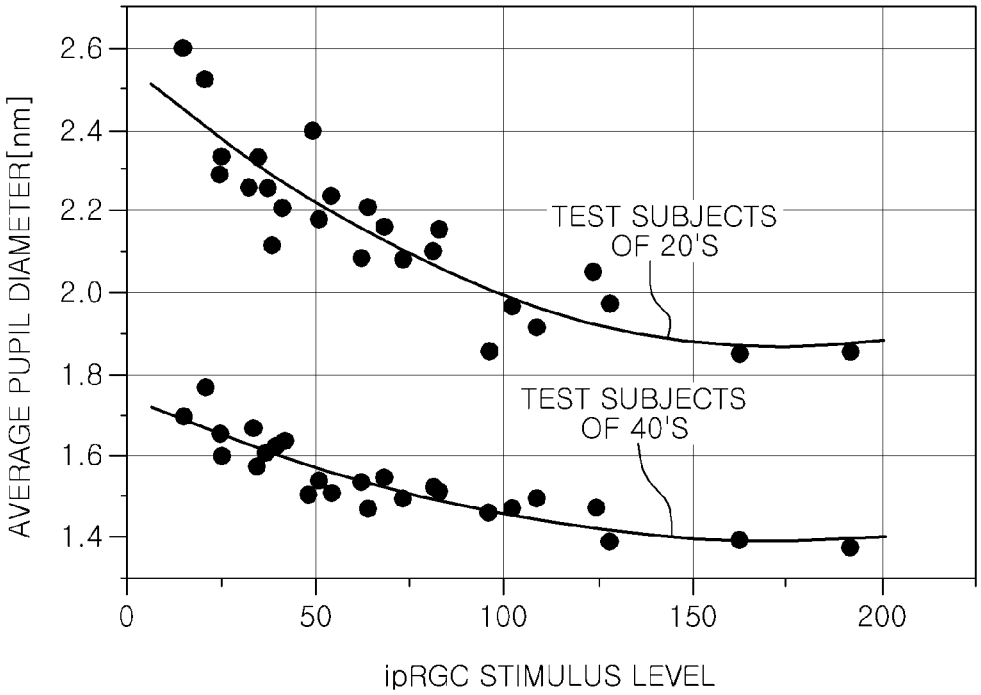
FIG. 11 shows relation between the ipRGC stimulus level and an average pupil diameter.

As shown in FIG. 11, the average pupil diameters depicted in FIG. 8 have been plotted about the ipRGC stimulus level calculated as above. As a result, it has been found that the average pupil diameter decreases as the ipRGC stimulus level increases. In other words, if the ipRGC is strongly stimulated by increasing the ipRGC stimulus level, the average pupil diameter is decreased and the depth of field is increased. Accordingly, a user can easily read characters written on a paper.

Next, the ipRGC stimulus level by the light emitted from the first LED 4, i.e., the light for allowing characters written on a paper to be easily legible, at the illuminance 1000 lx, was calculated. As can be seen from the following table 1, in the light having a correlated color temperature of about 3000K and Duv of −2.8 to −15.3, the ipRGC stimulus level was 57 to 59. In the light having a correlated color temperature of about 3500K and Duv of −2.5 to −14.5, the ipRGC stimulus level was 62 to 64. In the light having a correlated color temperature of about 4000K and Duv of −2.8 to −14.9, the ipRGC stimulus level was 68 to 70.

TABLE 1

| Correlated color temperature | Duv | ipRGC stimulus level |
|---|---|---|
| 3012 K | −2.8 | 57 |
| 3000 K | −6.1 | 59 |
| 2996 K | −9.3 | 57 |
| 3027 K | −11.3 | 57 |
| 2990 K | −15.3 | 57 |
| 3478 K | −2.5 | 63 |
| 3513 K | −4.8 | 64 |
| 3485 K | −8.5 | 64 |
| 3513 K | −10.7 | 63 |
| 3487 K | −14.5 | 62 |
| 3996 K | −2.8 | 68 |
| 3972 K | −6.2 | 69 |
| 4009 K | −9.0 | 68 |
| 3995 K | −11.8 | 70 |
| 3976 K | −14.9 | 70 |

The ipRGC stimulus level by the light emitted from the second LED 5, i.e., the light for relaxing a user with a low degree of awakening, was calculated. As can be seen from the following Table 2, in the light having a correlated color temperature of about 3000K and Duv of 0.4 to 6.4, the ipRGC stimulus level was 55 to 56. In the light having a correlated color temperature of about 3500K and Duv of 0.9 to 7.8, the ipRGC stimulus level was 60 to 61. In the light having a correlated color temperature of about 4000K and Duv of −0.2 to 3.1, the ipRGC stimulus level was 67.

TABLE 2

| Correlated color temperature | Duv | the ipRGC stimulus level |
|---|---|---|
| 3009 K | 6.4 | 55 |
| 3020 K | 3.1 | 55 |
| 3016 K | 0.4 | 56 |
| 3520 K | 7.8 | 60 |
| 3486 K | 3.5 | 60 |
| 3507 K | 0.9 | 61 |
| 3996 K | 3.1 | 67 |
| 3972 K | −0.2 | 67 |

The ipRGC stimulus level by the lights (illuminance of 1000 lx) emitted from a reference light source D65 and various general light sources (general fluorescence lamp, general LED and bulb) were calculated. As can be seen from the following table 3, the ipRGC stimulus level by the light having correlated color temperature of 6506K emitted from the standard light source D65 was set to 100, as described above. In the light having correlated color temperature of 3199K to 7204K emitted from the general fluorescence lamp, was the ipRGC stimulus level was 49 to 90, and the ipRGC stimulus level increased as the correlated color temperature increased. In the light having correlated color temperature of 2882K to 7201K emitted from the general LED, the ipRGC stimulus level was 42 to 101, and the ipRGC stimulus level increased as the correlated color temperature increased like the general fluorescence lamp. In the light having correlated color temperature of 2750K emitted from the bulb, the ipRGC stimulus level was 48.

TABLE 3

| | Correlated color temperature | Duv | the ipRGC stimulus level |
|---|---|---|---|
| D65 | 6506 K | 3.2 | 100 |
| General fluorescence lamp | 3199 K | −5.2 | 49 |
| | 4173 K | 8.0 | 53 |
| | 5198 K | −2.0 | 74 |
| | 6174 K | 11.0 | 82 |
| | 7204 K | −2.0 | 90 |
| General LED | 2882 K | 3.0 | 42 |
| | 3787 K | 1.0 | 57 |
| | 4279 K | 3.0 | 63 |
| | 5215 K | −2.8 | 80 |
| | 7201 K | −1.0 | 101 |
| Bulb | 2750 K | 0.0 | 48 |

Figure 12:
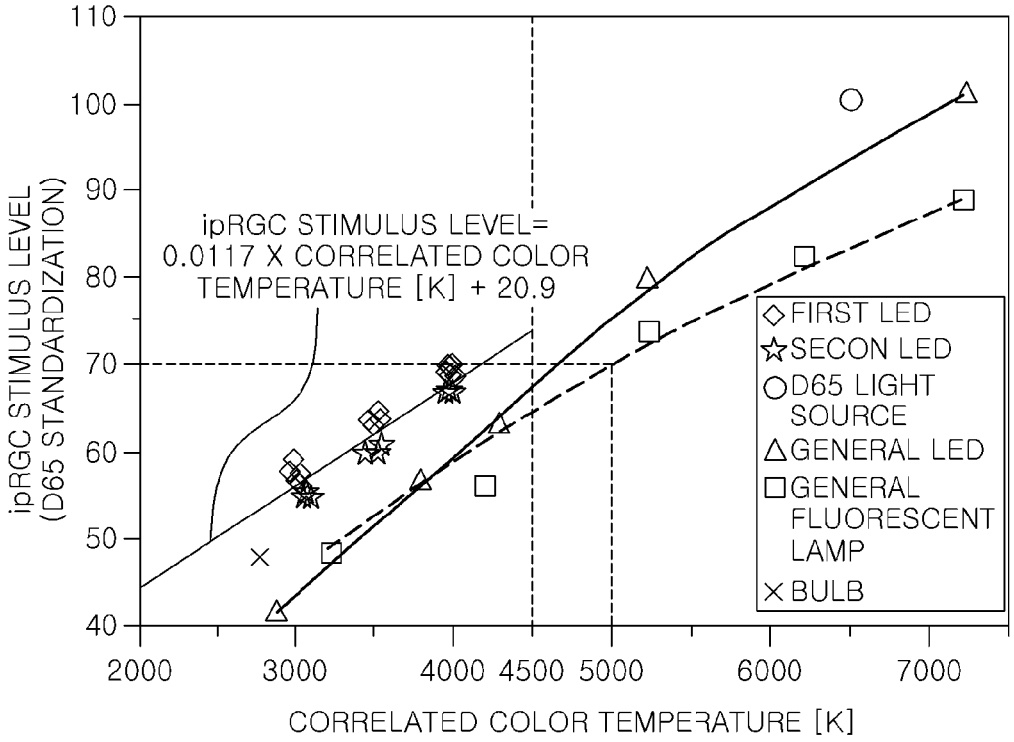
FIG. 12 shows relation between a correlated color temperature and the ipRGC stimulus level.

FIG. 12 is a graph showing the calculated ipRGC stimulus level plotted with respect to the correlated color temperature. In the white light emitted from the first LED 4 (indicated by diamond marks), the ipRGC stimulus level was greater than the value calculated in the following equation 3. On the other hand, in the white light emitted from the second LED 5 (indicated by star marks), the ipRGC stimulus level was smaller than the value calculated in the following equation 3. The ipRGC stimulus level by the white lights emitted from the first LED 4 and the second LEDs 5 at the correlated color temperature of 4500K or less was greater than the ipRGC stimulus level by the lights emitted from the general LED, the general fluorescence lamp and the bulb (respectively indicated by triangular marks, quadrilateral marks, and x marks). Therefore, at the correlated color temperature of 4500K or less, the white light emitted from the first LED 4 and the second LEDs 5 make the average pupil diameter smaller than that in the case of the lights emitted from the general LED, the general fluorescence lamp or the bulb. Accordingly, the depth of field is increased and a user can read characters easily.

$$\text{ipRGC stimulus level} = 0.0117 \times \text{correlated color temperature [K]} + 20.9 \quad \text{Eq. 3}$$

Figure 13:
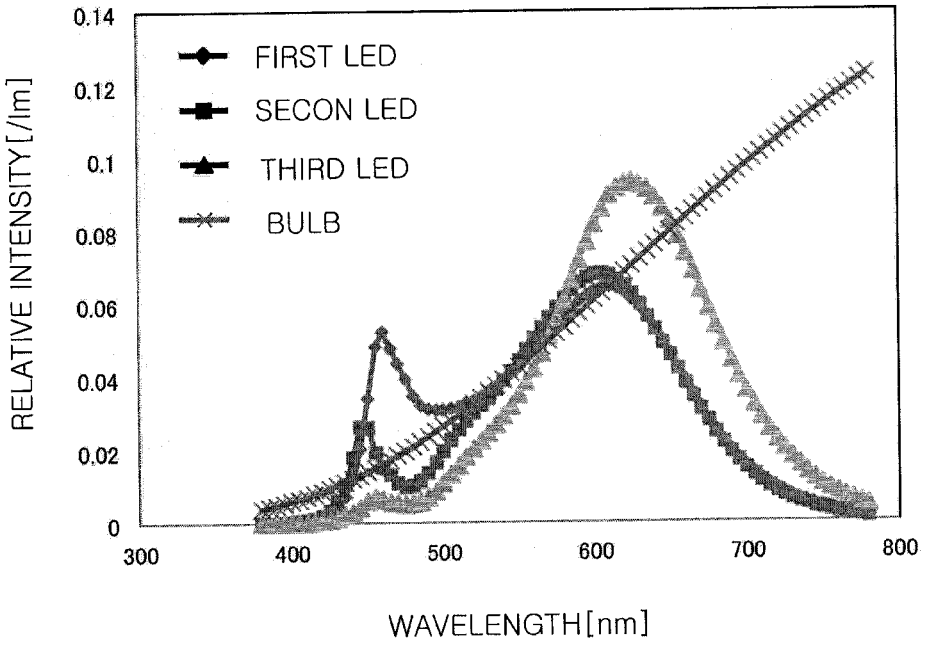
FIG. 13 shows spectral distributions of lights emitted from a first LED, a second LED and the like of the light source unit.

FIG. 13 shows exemplary spectrums (2 peak wavelength) of the white lights emitted from the first LED 4 and the second LEDs 5, respectively. As can be seen from the following Table 4, the white light emitted from the first LED 4 gives a correlated color temperature of 3446K, a Duv of −5.7, the ipRGC stimulus level of 66, and a general color rendering index Ra of 89, and a biological effect intensity of 0.54. The biological effect intensity denotes an intensity of suppression of melatonin secretion which is calculated by using prediction model for effect amount (DIN 5031-100) of Deutsches Institut fur Normung, and as the biological effect intensity increases, the melatonin secretion is suppressed. The white light emitted from the second LEDs 5 gives a correlated color temperature of 2882K, a Duv of 3.4, the ipRGC stimulus level of 42, a general color rendering index Ra of 81, a biological effect intensity of 0.31.

TABLE 4

| | x | y | Correlated color temperature | Duv | the ipRGC stimulus level | Ra | Biological effect intensity |
|---|---|---|---|---|---|---|---|
| First LED | 0.4023 | 0.3765 | 3466 | −5.7 | 66 | 89 | 0.54 |
| Second LED | 0.4510 | 0.4175 | 2882 | 3.4 | 42 | 81 | 0.31 |
| Third LED | 0.5327 | 0.4222 | 2006 | 2.8 | 25 | 84 | 0.14 |
| Bulb | 0.4558 | 0.4096 | 2750 | 0.0 | 48 | 100 | 0.35 |

There is shown in FIG. 13 and Table 4 a third LED which emits white light having a biological effect intensity lower than that of white light emitted from the second LEDs 5 so that the white light of the third LED has difficulty in suppressing melatonin secretion and thus provides a high relax effect. For example, the third LED gives a correlated color temperature of 2006K, a Duv of 2.8, the ipRGC stimulus level of 25, a general color rendering index Ra of 84, and a biological effect intensity of 0.14. The bulb used as a comparative example gives a correlated color temperature of 2750K, a Duv of 0.0, the ipRGC stimulus level of 48, a general color rendering index Ra of 100, and a biological effect intensity of 0.35.

Figure 14:
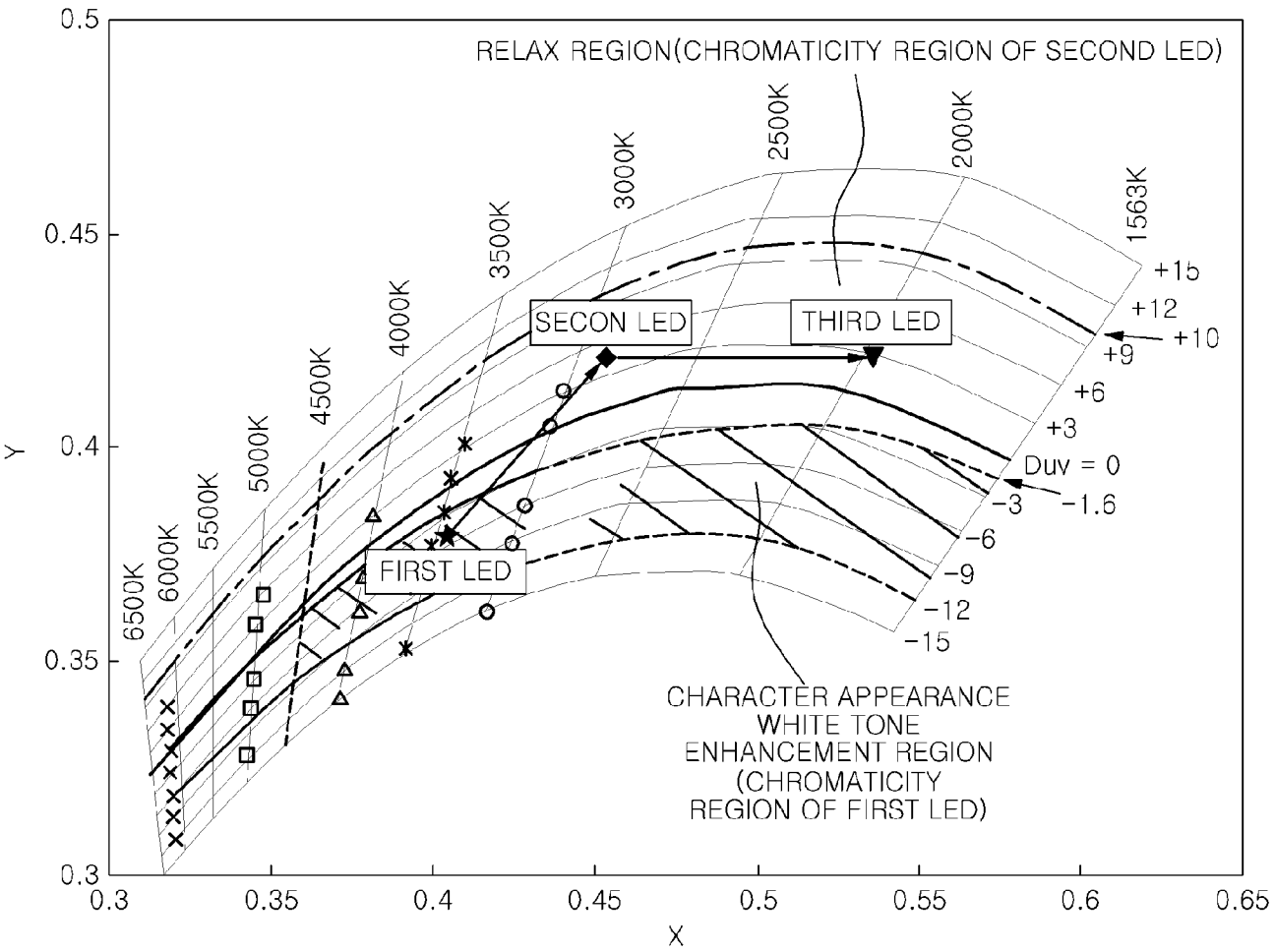
FIG. 14 is an xy chromaticity diagram showing an example of controlling a light output ratio of the first LED and the second LED.

Hereinafter, how to control lighting of the first LED 4, the second LEDs 5 and the third LED described in Table 4 in the case where a user reads a book before sleeping will be described, for example. As can be seen from FIG. 14, when a user starts reading, the first LED 4 is fully turned on, e.g., 100% turned on to emit white light having good "legibility" of characters which is suitable for reading (indicated by star marks, hereinafter, referred to as "first state"). In the first state, the user can read a book comfortably.

Next, as the lighting period of the first LED 4 is increased, the control unit 6 gradually decreases the light output of the first LED 4 and gradually increases the light output of the second LEDs 5 so that the second LEDs 5 come into fully turned-on state, e.g., 100% turned on state (indicated by diamond marks, hereinafter, referred to as "second state"). While shifting from the first state to the second state, the correlated color temperature and Duv of the irradiation light are changed so gradually and naturally that it is difficult for the user to recognize the shift from the first state to the second state. In the second state, the second LEDs 5 emit light that hardly suppresses melatonin secretion. Accordingly, melatonin is secreted in a user's body, thereby allowing the body temperature to fall and facilitating the user's falling asleep.

The second state is gradually shifted to a state in which the third LED is fully turned on, e.g., 100% turned on (indicated by inverted triangular marks, hereinafter, referred to as "third state"). In the third state, light having a lower biological effect intensity is emitted compared to the second state and, thus, secretion of melatonin is facilitated. As a result, the user is guided to comfortable sleep.

Due to the shifting from the first state to the third state via the second state, the illumination environment suitable for reading a book can be smoothly and gradually shifted to the illumination environment suitable for sleeping. Shifting pattern is not limited thereto. For example, the first state may be directly shifted to the third state without shifting to the second state, or the first state may be shifted to the second state without shifting to the third state.

As described above, the first LED 4 emits white light that can make a paper looked white at the correlated color temperature of 1563K to 4500K and Duv of −1.6 to −12. The second LEDs 5 emit white light of a lower correlated color temperature and a higher Duv than those of the white light emitted from the first LED 4. Specifically, the second LEDs 5 emit white light having a correlated color temperature of 1563K to 4500K and Duv of +10 to −1.6, which is low in terms of a degree of awakening. Accordingly, the illumination apparatus 1 can irradiate light for relaxing a user and light for making characters legible in a low color temperature environment without discomfort.

White light emitted from the first LED 4 is not limited to one having two peak wavelengths as shown in FIG. 13 and may be one having three or four peak wavelengths. Therefore, a virtual emission spectrum (Gauss distribution) having three peak wavelengths was obtained by performing simulation where using, as parameters, three levels of 20, 30, 40 nm FWHM (Full Width at Half Maximum) within a peak wavelength from 421 nm to 660 nm (10 nm notch).

Figure 15:
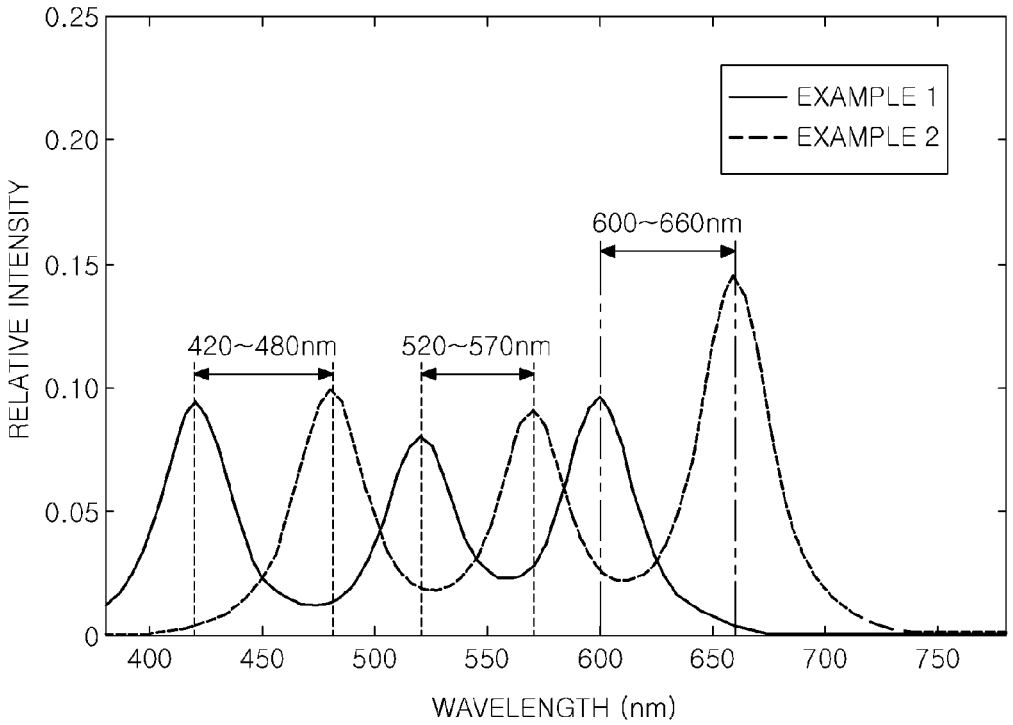
FIG. 15 shows spectral distribution of light (3 peak wavelength) emitted from the first LED.

As shown in FIG. 15, the virtual emission spectrum having the three peak wavelengths described above has a peak wavelength in wavelength bands of, e.g., 420 nm to 480 nm, 520 nm to 570 nm, and 600 nm to 660 nm, respectively. Light of an example 1 (indicated by a solid line) has peak wavelengths at 420 nm, 520 nm and 600 nm. Light of an example 2 (indicated by a dashed line) has peak wavelengths at 480 nm, 570 nm and 660 nm.

Figure 16:
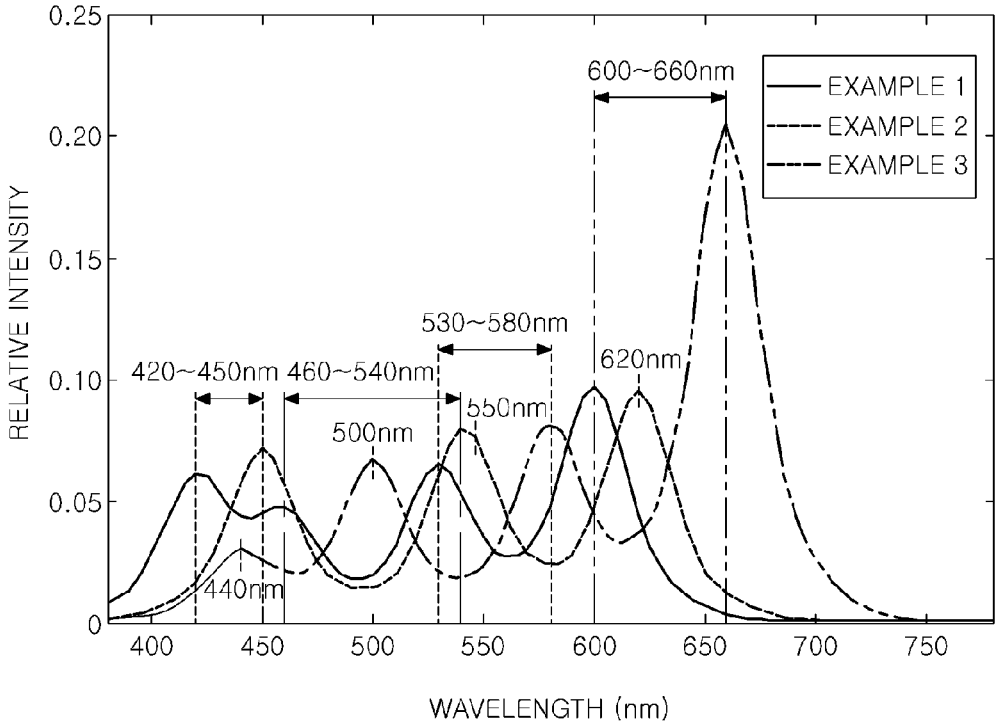
FIG. 16 shows spectral distribution of light (4 peak wavelength) emitted from the first LED.

In the same manner, a virtual emission spectrum having four peak wavelengths was obtained by simulation. As shown in FIG. 16, the virtual emission spectrum has four peak wavelengths in wavelength bands of, e.g., 420 nm to 450 nm, 460 nm to 540 nm, 530 nm to 580 nm and 600 nm to 660 nm, respectively. Light of an example 3 (indicated by a solid line) has peak wavelengths at 420 nm, 460 nm, 530 nm and 600 nm. Light of an example 4 (indicated by a dashed line) has peak wavelengths at 450 nm, 540 nm, 550 nm and 620 nm. Light of an example 5 (indicated by a dashed double-dotted line) has peak wavelengths at 440 nm, 500 nm, 580 nm and 660 nm.

As can be seen from Table 5, the lights of the examples 1 to 5 give the ipRGC stimulus level of 73, 91, 73, 70 and 70, respectively. Here, the light having a correlated color temperature of 5000K which is emitted from a general fluorescence lamp and used as a task illumination light gives the ipRGC stimulus level of about 70, as shown in FIG. 12. In other words, the ipRGC stimulus level given by the lights of the examples 1 to 5 which have the correlated color temperature of 3000K to 4500K is greater than or equal to that of the general task illumination light having a correlated color temperature of 5000K. Accordingly, the lights of the examples 1 to 5 can increase the depth of field by giving high ipRGC stimulus level even at a low correlated color temperature. Therefore, the lights of the examples 1 to 5 can provide "legibility" that is the same as or better than that of the general task illumination light having a correlated color temperature of 5000K.

TABLE 5

| | Correlated color temperature | Duv | the ipRGC stimulus level | Ra | Peak wave length 1 | Peak wave length 2 | Peak wave length 3 | Peak wave length 4 |
|---|---|---|---|---|---|---|---|---|
| Ex. 1 | 4500 K | −1.6 | 73 | 84 | 420 nm | 520 nm | 600 nm | — |
| Ex. 2 | 4500 K | −1.6 | 91 | 81 | 480 nm | 570 nm | 550 nm | — |
| Ex. 3 | 4500 K | −12 | 73 | 85 | 420 nm | 460 nm | 530 nm | 600 nm |
| Ex. 4 | 4500 K | −12 | 70 | 82 | 450 nm | 540 nm | 550 nm | 620 nm |
| Ex. 5 | 3000 K | −1.6 | 70 | 85 | 440 nm | 500 nm | 580 nm | 660 nm |

The illumination apparatus of the disclosure is not limited to that of the above embodiment and may be variously modified. For example, the illumination apparatus is not limited to a bedside lamp and may be a stand light provided at a table or the like. Besides, a plurality of first LEDs and a plurality of second LEDs may be installed in a mixed manner on a wiring substrate so that white light emitted from the first LEDs and white light emitted from the second LEDs can be easily mixed with each other.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. An illumination apparatus comprising:

a first LED configured to emit white light;

a second LED configured to emit white light having a correlated color temperature lower than a correlated color temperature of the white light emitted from the first LED and a chromaticity deviation Duv higher than a chromaticity deviation Duv of the white light emitted from the first LED; and a controller configured to change a light output ratio of the first LED and the second LED, wherein the first LED emits the white light having a correlated color temperature ranging from 1563K to 4500K and a chromaticity deviation Duv ranging from −1.6 to −12, the second LED emits the white light having a correlated color temperature ranging from 1563K to 4500K and a chromaticity deviation Duv ranging from +10 to −1.6, and the controller controls such that in a xy chromaticity diagram, the white light emitted from the first LED is plotted in a region between a first curved line expressed by a following equation 1 and a second curved line expressed by a following equation 2, and the white light emitted from the second LED is plotted in a region between the first curved line and a third curved line indicating a chromaticity deviation Duv+10:

$$y=-2.6186x^2+2.5412x-0.2147 \quad \text{Eq. 1}$$

$$y=-3.1878x^2+2.8976x-0.2836 \quad \text{Eq. 2.}$$

2. The illumination apparatus of claim 1, wherein an intrinsic photosensitive retinal ganglion cell (ipRGC) stimulus level of the white light emitted from the first LED, which is a value standardized by setting an ipRGC stimulus level of light having illuminance of 1000 1× emitted from a D65 light source, is greater than or equal to a value calculated by a following equation 3, and an ipRGC stimulus level of the white light emitted from the second LED is smaller than the value calculated by the following equation 3;

$$\text{ipRGC stimulus level}=0.0117\times\text{correlated color temperature [K]}+20.9 \quad \text{Eq. 3.}$$

3. The illumination apparatus of claim 1, wherein the controller decreases a light output of the first LED as a lighting period of the first LED increases.

4. The illumination apparatus of claim 3, wherein when the controller decreases the light output of the first LED, the control unit gradually increases a light output of the second LED.

5. The illumination apparatus of claim 1, wherein the white light emitted from the first LED has peak wavelengths in wavelength bands of 420 nm to 480 nm, 520 nm to 570 nm, and 600 nm to 660 nm, respectively.

6. The illumination apparatus of claim 1, wherein the white light emitted from the first LED has peak wavelengths in wavelength bands of 420 nm to 450 nm, 460 nm to 540 nm, 530 nm to 580 nm, and 600 nm to 660 nm, respectively.

7. The illumination apparatus of claim 1, further comprising: a wiring substrate on which the first LED and the second LED are installed, the second LED comprising a plurality of second LEDs, wherein the first LED is installed at a center of the wiring substrate and one of the plurality of a second LEDs is installed at each corner of the wiring substrate.

8. The illumination apparatus of claim 1, further comprising: a wiring substrate on which a plurality of first LEDs and a plurality of second LEDs are installed in a mixed manner.

* * * * *